US005143822A

United States Patent [19]

Nishio

[11] Patent Number: 5,143,822

[45] Date of Patent: Sep. 1, 1992

[54] SILVER HALIDE PHOTOGRAPHIC LIGHT-SENSITIVE MATERIAL ELEMENT WITH ANTIHALATION LAYER CONTAINING OPTICAL BRIGHTENER

[75] Inventor: Shouji Nishio, Hino, Japan

[73] Assignee: Konica Corporation, Tokyo, Japan

[21] Appl. No.: 800,409

[22] Filed: Nov. 29, 1991

[30] Foreign Application Priority Data

Nov. 30, 1990 [JP] Japan ..... 2-339415

[51] Int. Cl.[5] ..... G03C 1/06

[52] U.S. Cl. ..... 430/522; 430/510; 430/517; 430/933

[58] Field of Search ..... 430/522, 517, 510, 933

[56] References Cited

U.S. PATENT DOCUMENTS

| | | | |
|---|---|---|---|
| 4,294,912 | 10/1981 | Postle et al. | 430/522 |
| 4,818,659 | 4/1989 | Takahashi et al. | 430/522 |
| 4,830,950 | 5/1989 | Kuwabara et al. | 430/522 |
| 4,940,654 | 7/1990 | Diehl et al. | 430/522 |

*Primary Examiner*—Jack P. Brammer
*Attorney, Agent, or Firm*—Jordan B. Bierman

[57] ABSTRACT

A silver halide photographic light-sensitive material is disclosed, which is improved in the sharpness of images and whitness of the background. The light-sensitive material comprises a reflective support having thereon a photographic layer including a silver halide emulsion layer and an antihalation layer provided between said support and said silver halide emulsion layer, wherein said antihalation layer contains fine dispersed particles of a compound represented by the following formula I, and at least one layer included in said photographic layer contains a fluorescent whitening agent;

$$A{=}L_1{-}(L_2{=}L_3)_m{-}B \qquad (I)$$

wherein A is a 2-pyrazoline-5-on nucleus; B is an 4-aminoaryl group; $L_1$, $L_2$, $L_3$ and $L_4$ are each a methine group; and m is 0 or 1, and group represented by A or B should have a specified substituent.

7 Claims, No Drawings

SILVER HALIDE PHOTOGRAPHIC LIGHT-SENSITIVE MATERIAL ELEMENT WITH ANTIHALATION LAYER CONTAINING OPTICAL BRIGHTENER

FIELD OF THE INVENTION

The present invention relates to a silver halide photographic light-sensitive material and more specifically to a silver halide photographic light-sensitive material having an excellent sharpness.

BACKGROUND OF THE INVENTION

For a silver halide photographic light-sensitive material which records optical information, it is an important function to reproduce optical information specially with a high fidelity.

The light incident upon a light-sensitive material travels in the light-sensitive material while spreading specially, and this spreading of light hinders faithful reproduction of optical information. The spreading of light is attributable, for example, to 1. scattering at the interface between photographic structural layers consisting of various hydrophilic colloids or the interface between said photographic structural layer and a support, 2. scattering caused not only by solid particles such as silver halide particles and matting agent particles but by oil droplets, respectively contained in photographic structural layers consisting of various hydrophilic colloids and 3. scattering due to a support.

In recent years, there have come to be used paper supports covered on both sides with a resin such as polyolefin, as the support for silver halide photographic light-sensitive materials in view of rapid processing. In these supports, a white pigment such as titanium dioxide is usually dispersed in the resin layer on the side to be coated with an emulsion layer. But the content of such a white pigment dispersed in the resin is limited to a certain level in respect of dispersion stability. For titanium dioxide, the upper limit of the content is usually about 15 wt %. But a content of this level is not sufficient in providing a good covering power; therefore, a portion of the light incident upon a light-sensitive material passes through the resin layer and diffuses into a paper substrate. A portion of the diffusing light returns again, repassing through the resin layer, to photographic structural layers consisting of hydrophilic colloids and exposes silver halide grains. As a result, obscurity or bleeding is caused in images, deteriorating the sharpness of images heavily. It is known in the art a technique to prevent the diffusion of light in a paper substrate by providing a hydrophilic colloid layer containing a dye or colloidal silver, which reduces the quantity of light coming into the paper substrate by absorbing the light which has passed through a photographic emulsion layer, between the photographic emulsion layer and the support. The layer provided between a photographic emulsion layer and a support for such a purpose is called an antihalation layer and described, for example, on pages 53–54 of Research Disclosure Vol. 175, Item 17559 (Nov. 1978) and on pages 649–650 of Research Disclosure Vol. 187, Item 18716 (Nov. 1979).

Further, with the increasing tendency toward high quality printed matters, the requirement of sharpness in processes of artworking, photographing and contact printing is getting more and more severe. That is to say, there has come to be strongly demanded the foregoing faithful reproduction of optical information free from obscurity and bleeding in images.

To color the antihalation layer, there are usually contained therein water-soluble dyes such as oxonol dyes having a pyrazolone nucleus or barbituric acid nucleus and described in British Pat. Nos. 506,385, 1,177,429, 1,311,884, 1,338,799, 1,385,371, 1,467,214, 1,433,102, 1,553,516, Japanese Pat. O.P.I. Pub. Nos. 85,130/1973, 14,420/1974, 161,233/1980, 111,640/1984 and U.S. Pat. Nos. 3,247,127, 3,469,985, 4,078,933; and oxonol dyes having a hydroxypyridone nucleus and described in British Pat. Nos. 1,278,621, 1,512,863, 1,521,083 and 1,579,899. These water-soluble dyes, however, are liable to lower the sensitivity and to cause fogging in a photographic emulsion layer. Some of them produce undesirable coloring on photographic images obtained by rapid processing which becomes practiced in recent years. Further, providing an antihalation layer lowers the white brightness of a paper support, this weakens the whiteness required of finished photographs and darkens images thereof.

SUMMARY OF THE INVENTION

Taking notice of the above problems, the present invention is made with the object of providing a silver halide photographic light-sensitive material free from sensitivity deterioration, less in fogging, excellent in sharpness and improved in whiteness.

The objects of the invention are attained by a silver halide photographic light-sensitive material comprising a reflective support having thereon a photographic layer including a silver halide emulsion layer and an atihalation layer provided between the support and the silver halide emulsion layer, wherein the antihalation layer contains fine dispersed particles of a compound represented by the following Formula I, and at least one layer included in said photographic layer contains a fluorescent whitening agent;

$$A{=}L_1{-}(L_2{=}L_3)_m{-}B \qquad (I)$$

wherein A is a 2-pyrazoline-5-on nucleus; B is an 4-aminoaryl group; $L_1$, $L_2$ and $L_3$ are each a mething group; and m is 0 or 1, provided that the compound satisfies at least one of the following requirements;

(1) said aminoaryl group represented by B has a carboxyl group, a sulfonamido group, an aminosulfonylamino group or a sulfamoyl group, (2) said 2-pyrazoline-5-on nucleus represented by A has a carboxyl group; a sulfonamido group; an aminosulfonylamino group; an aliphatic group having a carboxyl group, a sulfonamido group or an aminosulfonylamino group; a heterocyclic group having a carboxyl group, a sulfonamido group or an aminosulfonylamino group; an aryl group having a carboxyl group, a sulfonamido group or an aminosulfonylamino group; or a group having a sulfamoyl group.

DETAILED DESCRIPTION OF THE INVENTION

The present invention hereunder described in detail. First, Formula I is described.

The amino moiety of the 4-aminoaryl group represented by B inclides one having a substituent and a cyclic one. Examples of such a substituent are an alkyl group, a cycloalkyl group, an aryl group, an alkenyl group and a heterocyclic group.

The alkyl group includes, for example, methyl group, ethyl group, n-propyl group, iso-propyl group, t-butyl group, n-pentyl group, n-hexyl group, n-octyl group, 2-ethylhexyl group, n-pentadecyl group and eicosyl group. The alkyl group may have a substituent such as a halogen atom (e.g., chlorine, bromine or fluorine), an aryl group (e.g., phenyl or naphthyl group), cycloalkyl group (e.g., cyclopentyl or cyclohexyl group), heterocyclic group (e.g., pyyrolidyl or pyridyl group), sulfinic acid group, carboxyl group, nitro group, hydroxy group, mercapto group, amino group (e.g., amino or diethylamino group), alkyloxy group (e.g., methyloxy, ethyloxy, n-butyloxy, n-octyloxy or iso-propyloxy group), aryloxy group (e.g., phenyloxy or naphthyloxy group), carbamoyl group (e.g., carbamoyl, methylcarbamoyl or n-pentylcarbamoyl group), amido group (e.g., methylamido, benzamido or n-octylamido group), aminosulfonylamino group (e.g., aminosulfonylamino, methylaminosulfonyl or anilinosulfonylamino group), sulfamoyl group (e.g., sulfamoyl, methylsulfamoyl, phenylsulfamoyl, or n-butylsulfamoyl group), sulfonamido group (e.g., methanesulfonamido, n-heptanesulfonamido or benzenesulfonamido group), sulfinyl group (e.g., alkylsulfinyl group such as methylsulfinyl, ethylsulfinyl or octylsulfinyl, or arylsulfinyl group such as phenylsulfinyl), alkyloxycarbonyl group (e.g., methyloxycarbonyl, ethyloxycarbonyl, 2-hydroxyethloxycarbonyl or n-octyloxycarbonyl group), aryloxycarbonyl group (e.g., phenyloxycarbonyl or naphthyloxycarbonyl group), alkylthio group (e.g., methylthio, ethylthio or n-hexylthio group), arylthio group (e.g., phenylthio or naphthylthio group), alkylcarbonyl group (e.g., acetyl, ethylcarbonyl, n-butylcarbonyl or n-octylcarbonyl group), arylcarbonyl group (e.g., benzoyl, p-methanesulfonamidebenzoyl, p-carboxybenzoyl to naphthoyl group), cyano group, ureido group (e.g., methylureido or phenylureido group) or thioureido group (e.g., methylthioureido or phenylthioureido group).

Examples of the cycloalkyl group as the substituent on the amino moiety are cyclopropyl, cyclobutyl, cyclopentyl and cyclohexyl groups. These chcloalkyl groups may have a substituent; examples thereof include the above alkyl groups and the groups exemplified as substituents of those alkyl groups.

Examples of the aryl group as the substituent on the amino moiety include phenyl and naphthyl groups. These aryl groups may have a substituent; examples thereof include the above alkyl groups and the groups exemplified as substituents of those alkyl groups.

Examples of the alkenyl group as the substituent on the amino moiety include vinyl, allyl, 1-propenyl, 1,3-butadienyl and 2-pentenyl groups. These alkenyl groups may have a substituent; examples thereof include the above alkyl groups and the groups exemplified as substituents of those alkyl groups.

Examples of the heterocyclic group as the substituent on the amino moiety include pyridyl group (e.g., 2-pyridyl, 3-pyridyl, 4-pyridyl, 5-carboxy-2-pyridyl, 3,5-dichloro-2-pyridyl, 4,6-dimethyl-2-pyridyl, 6-hydroxy-2-pyridyl, 2,3,5,6-tetrafluoro-4-pyridyl or 3-nitro-2-pyridyl group), oxazolyl group (e.g., 5-carboxy-2-benzoxazolyl, 2-benzoxazolyl or 2-oxazolyl group), thiazolyl group (e.g., 5-sulfamoyl-2-benzothiazolyl, 2-benzothiazolyl or 2-thiazolyl group), imidazolyl group (e.g., 1-methyl-2-imidazolyl or 1-methyl-5-carboxy-2-benzimidazolyl group), furyl group (e.g., 3-furyl group), pyrrolyl group (e.g., 3-pyrroly group), thienyl group (e.g., 2-thienyl group), pyrazinyl group (e.g., 2-pyrazinyl group), pyrimidinyl group (e.g., 2-pyrimidinyl or 4-chloro-2-pyrimidinyl group), pyridazinyl group (e.g., 2-pyridazinyl group), purinyl group (e.g., 8-purinyl group), iso-oxazolyl group (e.g., 3-iso-oxazolyl group), selenazolyl group (e.g., 5-carboxy-2-selenazolyl group), sulfolanyl group (e.g., 3-sulfolanyl group), piperidinyl group (e.g., 1-methyl-3-piperidinyl group), pyrazolyl group (e.g., 3-pyrazolyl group) and tetrazolylgroup (e.g., 1-methyl-5-tetrazolyl group). These heterocyclic groups may have a substituent; examples thereof are the above alkyl groups and groups exemplified as substituents of those alkyl groups. Examples of the cyclic amino moiety include, for example, piperidine, piperazine and morpholine ridded of respective nitrogen-linked hydrogen atoms. Such cyclic amino groups may have a substituent; examples thereof include the above alkyl groups and the groups exemplified as substituents of those alkyl groups.

The aryl moiety of the 4-aminoaryl group represented by B is preferably a phenyl group. The aryl moiety includes ones further having a substituent other than the 4-amino group; examples of such a substituent include the foregoing alkyl groups and the groups exemplified as substituents of those alkyl groups.

Further, the 4-aminoaryl group includes ones in which a substituent on the amino moiety is linked with a carbon atom on the aryl moiety to form a ring such as piperidine ring or or julolydyl ring.

The methine group represented by $L_1$, $L_2$ or $L_3$ may have a substituent; examples thereof include alkyl group (e.g., methyl, ethyl, 3-hydroxypropyl or benzyl group), halogen atom (e.g., fluorine, chlorine or bromine atom), aryl group (e.g., phenyl group), alkoxy group (e.g., methoxy or ethoxy group); and these substituent groups may further have a substituent exemplified above as a substituent of the alkyl group which is a substituent on the amino moiety.

The 2-pyrazoline-5-one nucleus represented by A may have a substituent. Examples of the substituent at the 1-position include alkyl, alkenyl, cycloalkyl, aryl and heterocyclic groups; and examples of the substituent at the 3-position include alkyl, alkenyl, cycloalkyl, aryl, heterocyclic, carboxyl, carbamoyl, oxycarbamoyl, amino, amido, ureido, sulfonamido, aminosulfonylamino, hydroxy, alkyloxy, aryloxy, acyl, cyano, sulfamoyl, sulfonyl, sulfinyl, mercapto, alkylthio and arylthio groups. Examples of the alkyl, alkenyl, cycloalkyl, aryl and heterocyclic groups as substituents at the 1- or 3-position are those exemplified as substituents on the 4-amino moiety of the above 4-aminoaryl group, and each of them may further have a substituent. Examples of such a substituent include those exemplified as substituents on the aryl group which is a substituent of the above 4-amino moiety.

Examples of the amino group as a substituent at the 3-position include alkylamino, dialkylamino and arylamino groups. And the alkyl and aryl moieties are those alkyl and aryl groups which are exemplified as substituents on the above 4-amino moiety. Each of them may have a substituent; examples thereof are those exemplified as substituents on the aryl group which is a substituent of the above 4-amino moiety.

Examples of the oxycarbonyl group as a substituent at the 3-position include alkyloxycarbonyl, aryloxycarbonyl and heterocycloxycarbonyl groups; examples of the acyl group include alkylcarbonyl, arylcarbonyl and heterocyclocarbonyl groups; examples of the carbamoyl group include carbamoyl, alkylcarbamoyl and arylcarbamoyl groups as well as heterocyclocarbamoyl groups including nitrogen-containing heterocyclocarbamoyl groups such as 1-piperidinocarbonyl and 4-morpholinocarbonyl groups; examples of the ureido group include alkylureido, arylureido and heterocycloureido groups; examples of the amido group include alkylcarbonylamino, arylcarbonylamino and heterocyclocarbonylamino groups; examples of the sulfonamido group include alkylsulfonylamino, arylsulfonylamino and heterocyclosulfonylamino groups; examples of the aminosulfonylamino group include alkylaminosulfonylamino, dialkylaminosulfonylamino, arylaminosulfonylamino and heterocycloaminosulfonylamino groups; examples of the sulfamoyl group include sulfamoyl, alkylsulfamoyl, arylsulfamoyl and heterocyclosulfamoyl groups; examples of the sulfonyl group include alkylsulfonyl, arylsulfonyl and heterocyclosulfonyl groups; and examples of the sulfinyl group include alkylsulfinyl, arylsulfinyl and heterocyclosulfinyl groups. Examples of the alkyl, aryl and heterocyclic groups contained in the above groups, or the alkyl, aryl and heterocyclic groups contained in the alkyloxy, aryloxy, alkylthio and arylthio groups are those alkyl, aryl and heterocyclic groups which are exemplified as substituents on the above 4-amino moiety; each of which may have a substituent; and examples of such a substituent include those exemplified as substituents on the aryl group which is a substituent of the above 4-amino moiety.

In the invention, the compound represented by Formula I satisfies at least one of the foregoing requirement (1) or (2). And examples of the sulfonamido, aminosulfonyl and sulfamoyl groups contained in requirements (1) to (2) are those groups which are exemplified as substituents at the 3-position of the 2-pyrazoline-5-one nucleus; examples of the aliphatic and heterocyclic groups having a carboxyl, aminosulfonylamino or sulfonamido group specified in these conditions are those alkyl, alkenyl and heterocyclic groups which are exemplified as substituents on the above 4-amino moiety.

Typical examples of the compound of the invention are shown below, but the scope of the invention is by no means limited to them. Illustrated compounds

I-1

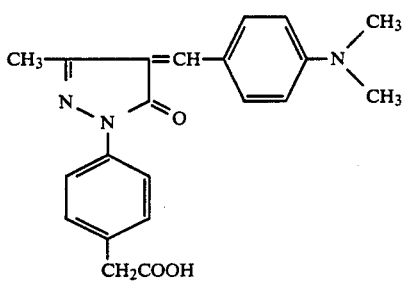

I-2

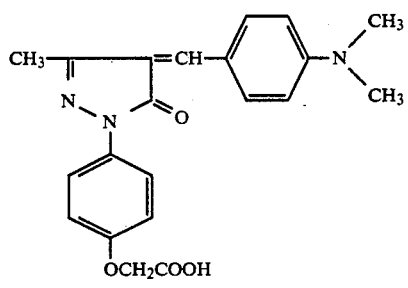

I-3

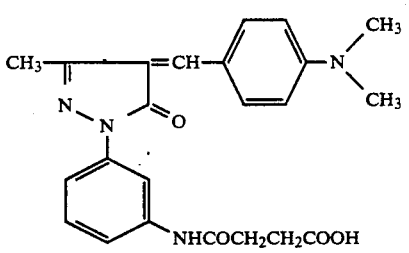

I-4

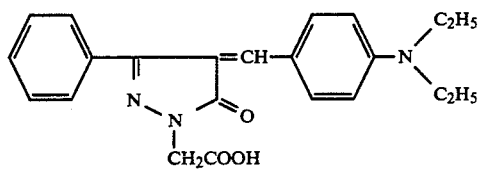

I-5

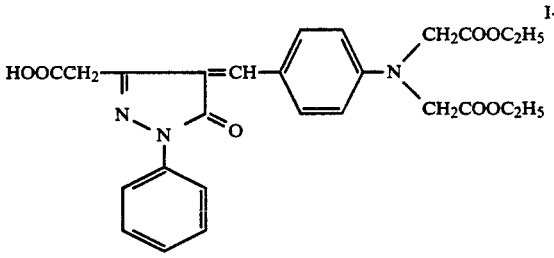

I-6

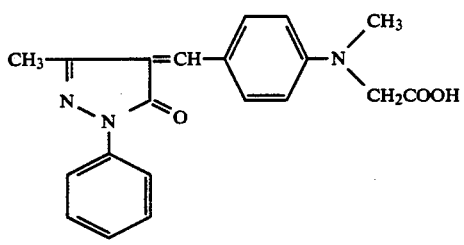

I-7

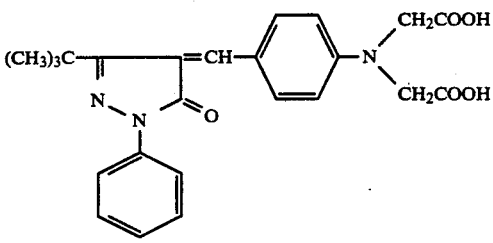

I-8

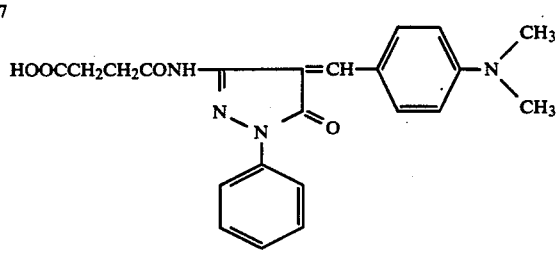

-continued
I-9
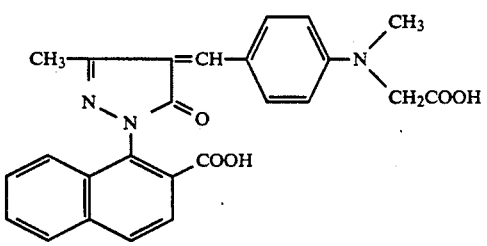
I-10
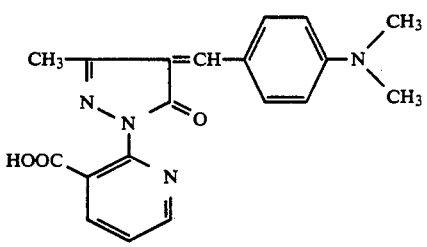
I-11
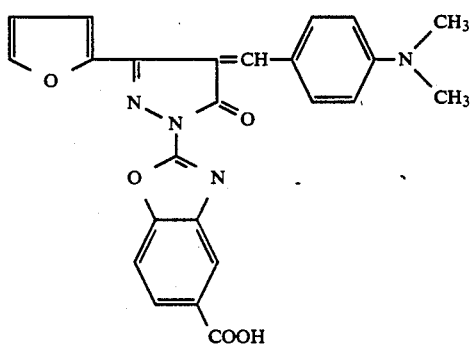
I-12
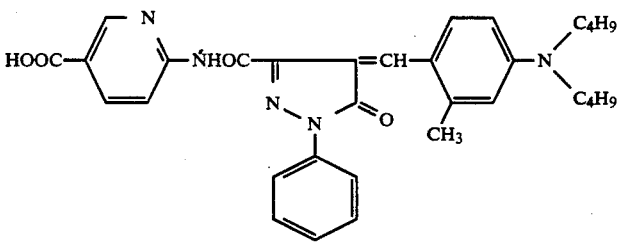
I-13
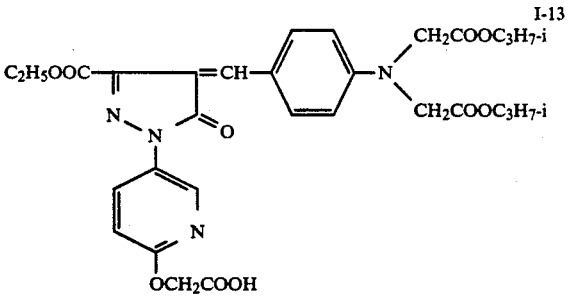
I-14
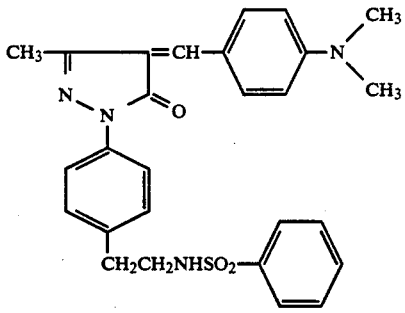
I-15
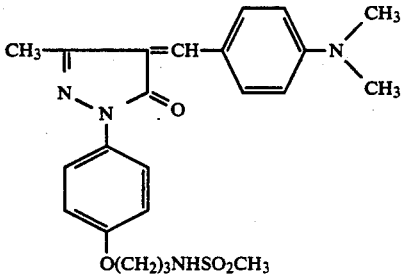
I-16
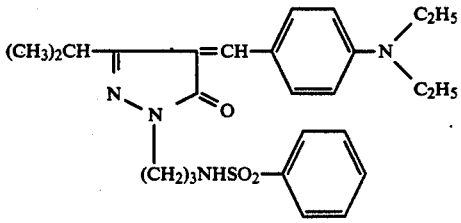

-continued
I-17
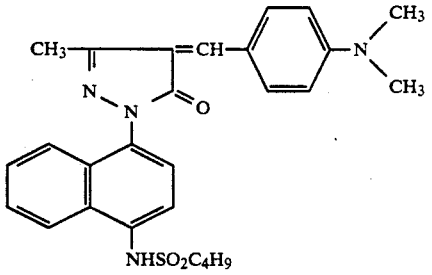
I-18
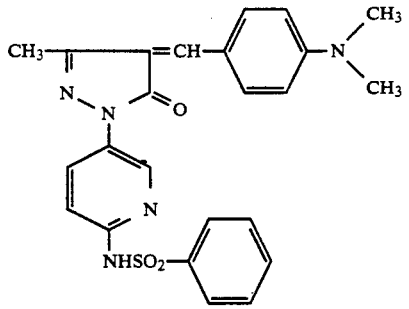
I-19
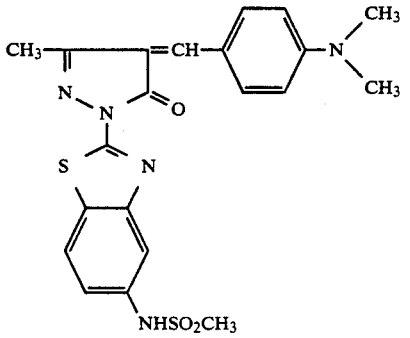
I-20
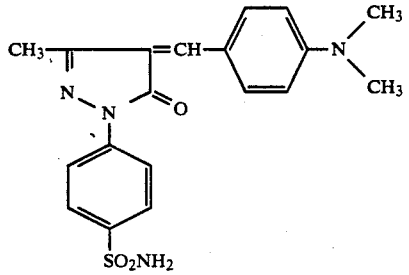
I-21
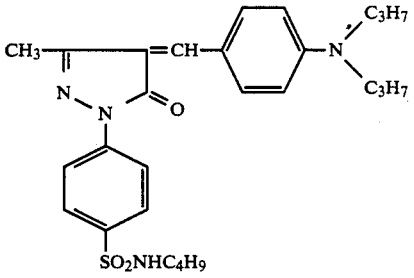
I-22
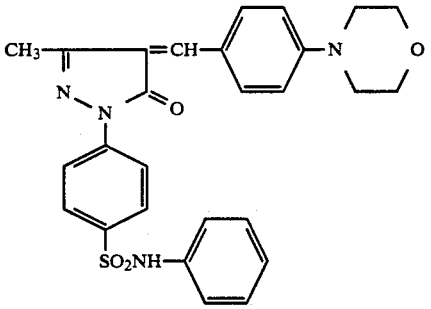
I-23
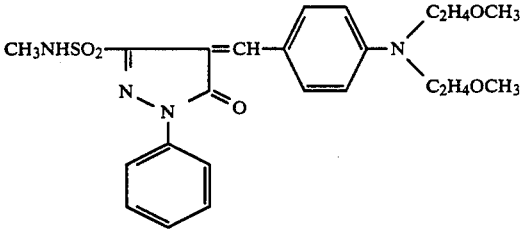
I-24
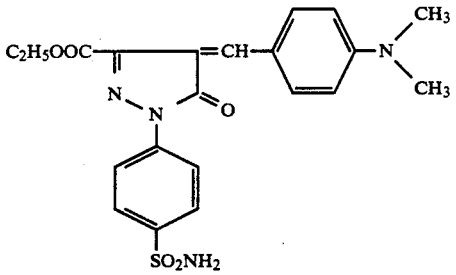
I-25
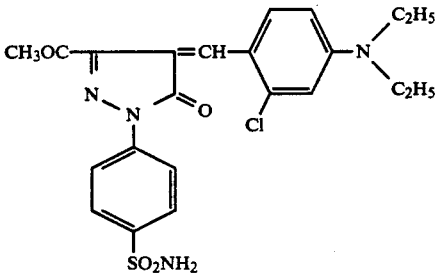
I-26
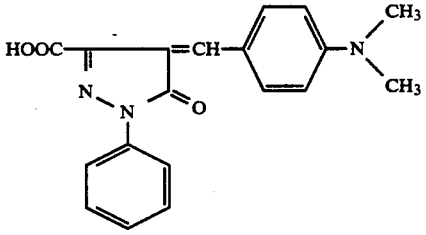

-continued
I-27
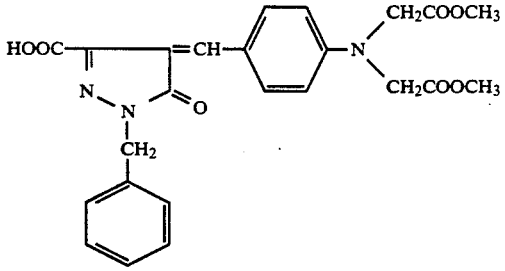
I-28
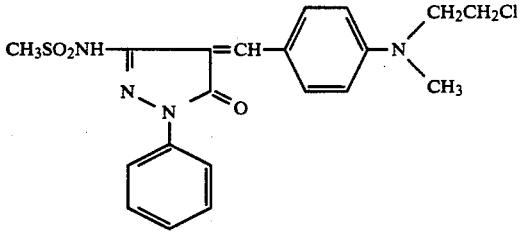
I-29
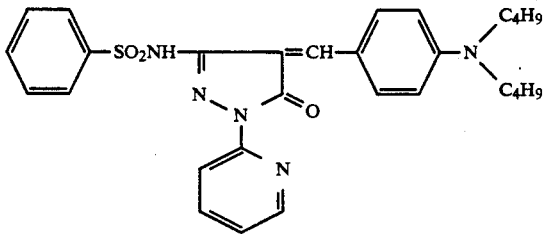
I-30
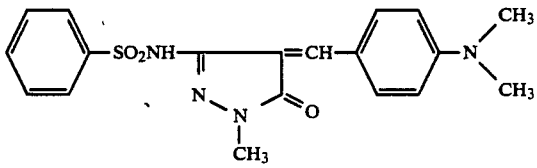
I-31
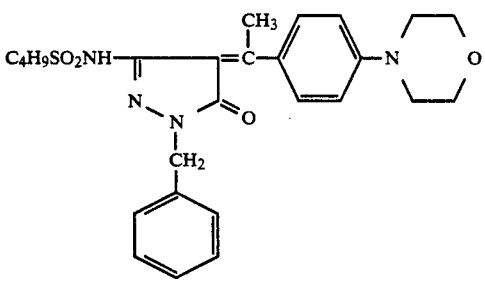
I-32
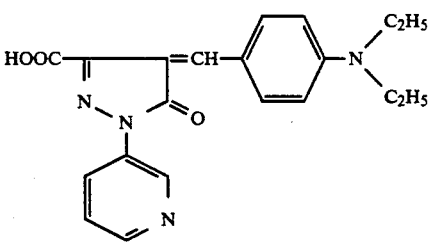
I-33
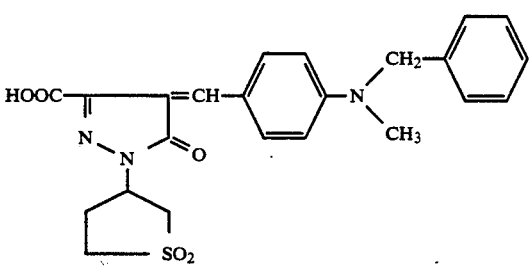
I-34
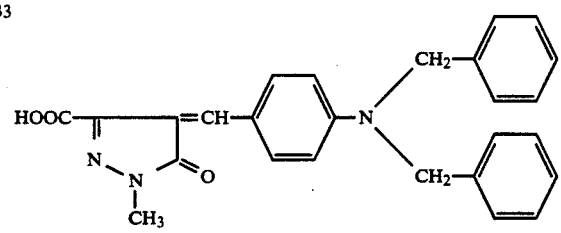
I-35
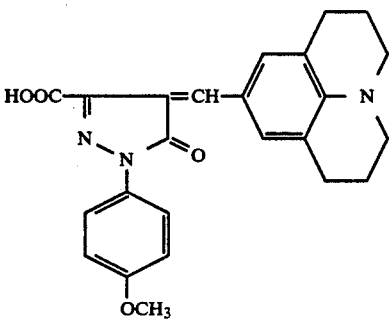
I-36
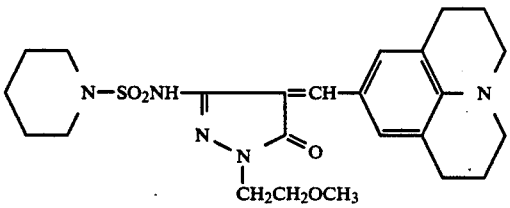

-continued
I-37
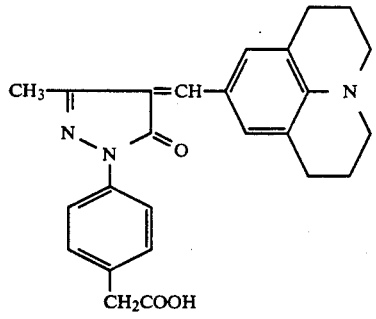
I-38
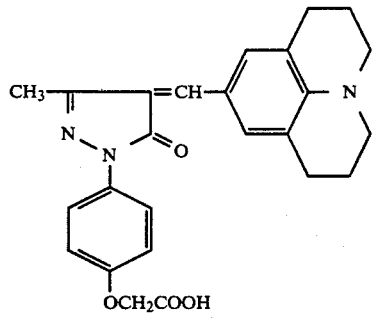
I-39
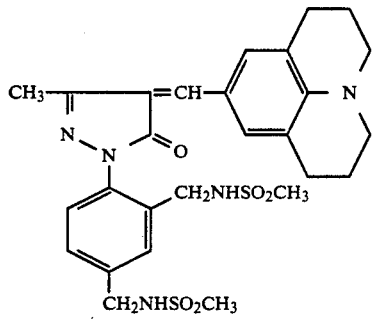
I-40
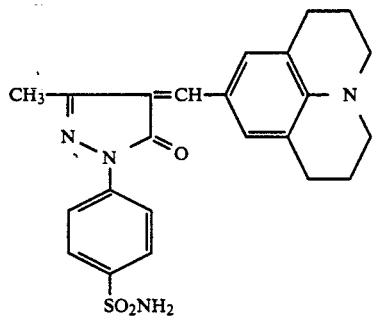
I-41
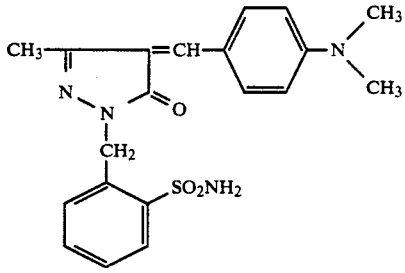
I-42
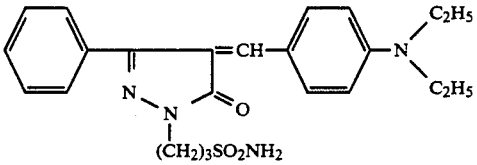
I-43
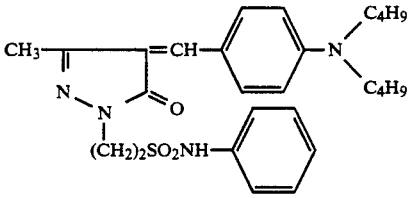
I-44
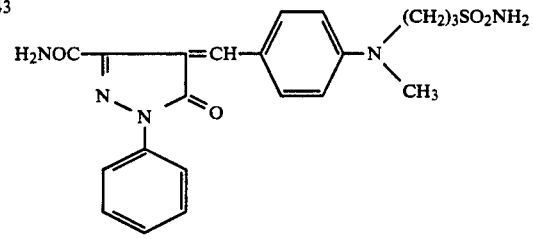
I-45
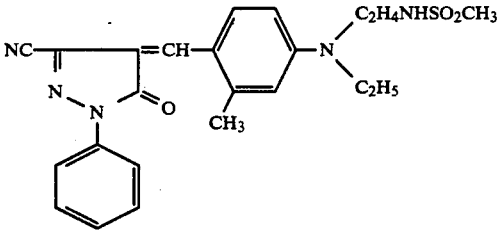
I-46
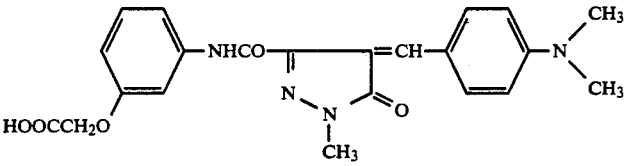

-continued
I-47
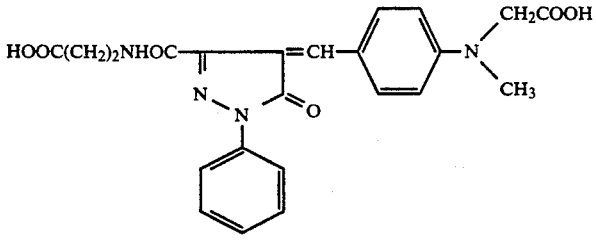
I-48
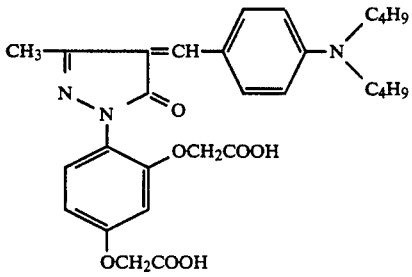
I-49
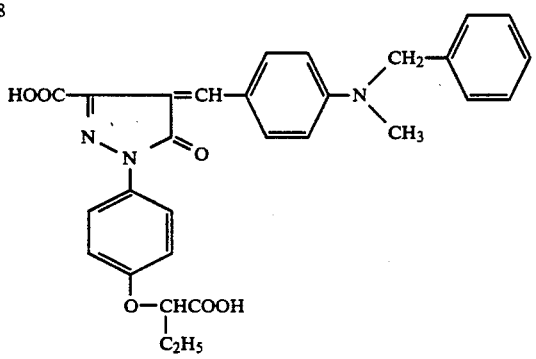
I-50
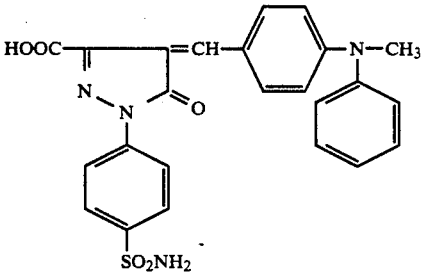
I-51
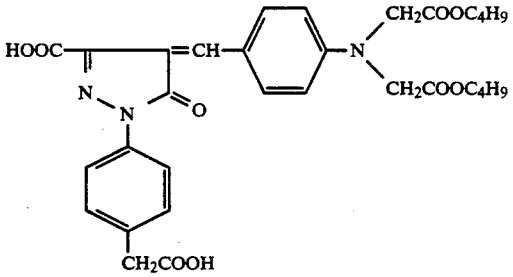
I-52
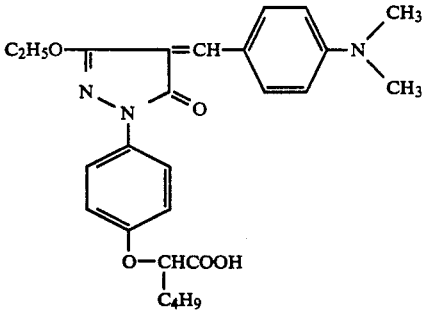
I-53
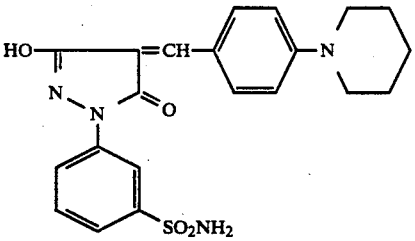
I-54
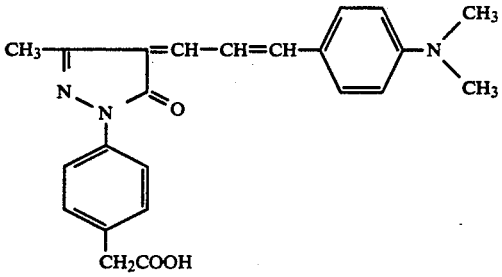
I-55
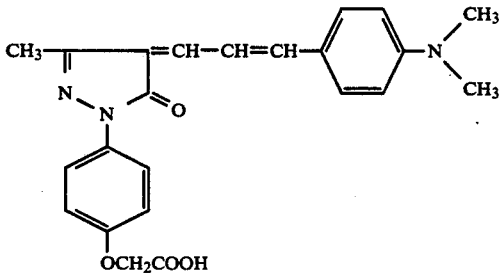

-continued
I-56
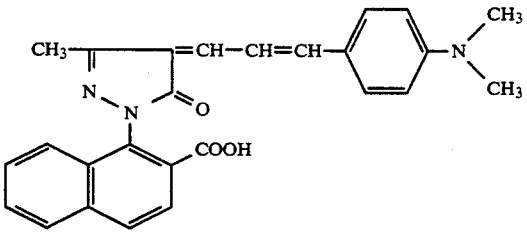
I-57
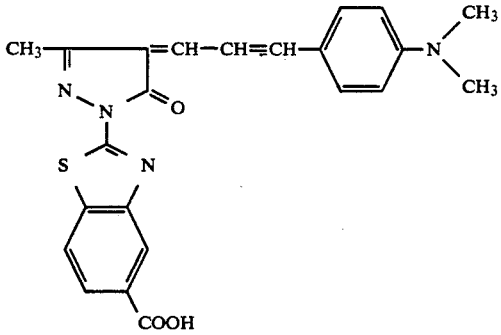
I-58
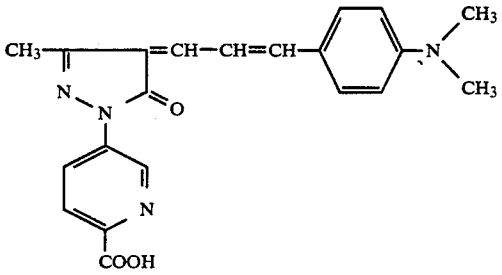
I-59
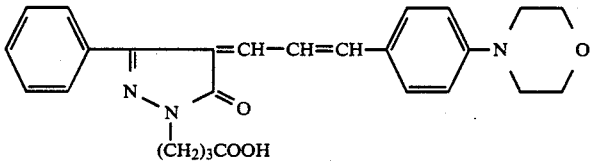
I-60
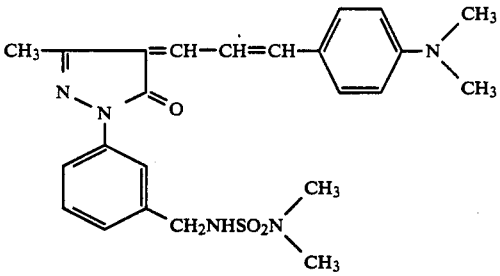
I-61
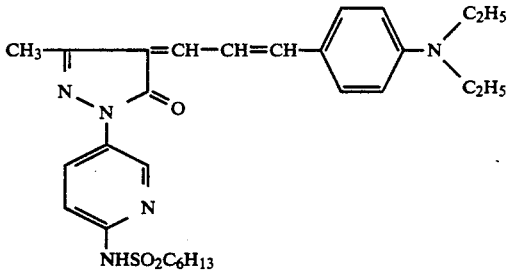
I-62
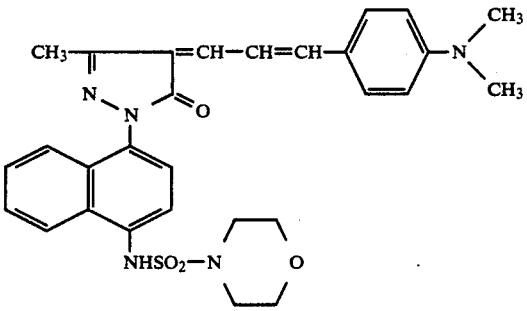
I-63
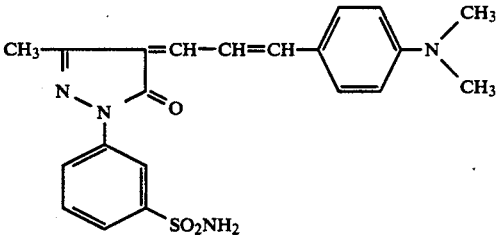

-continued
I-64
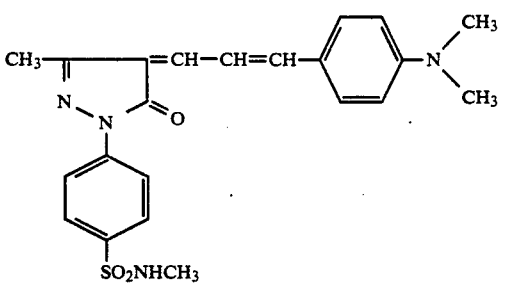
I-65
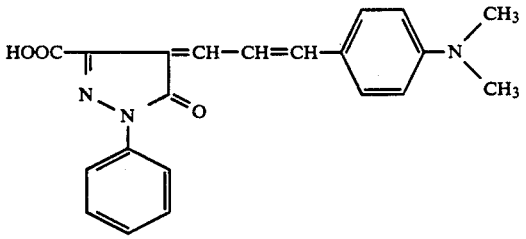
I-66
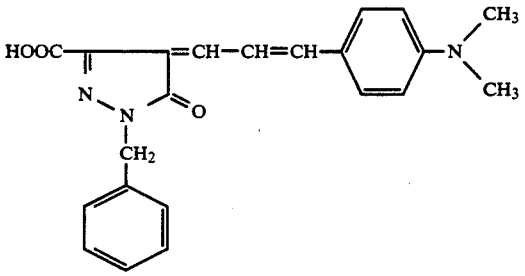
I-67
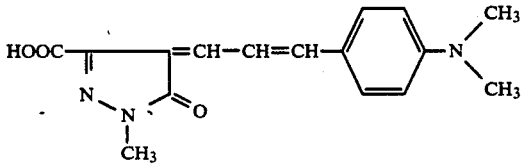
I-68
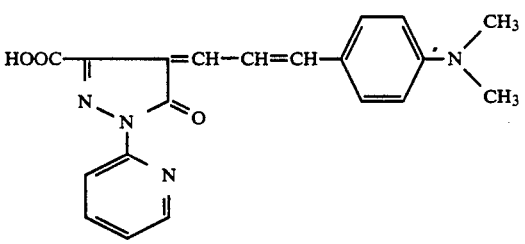
I-69
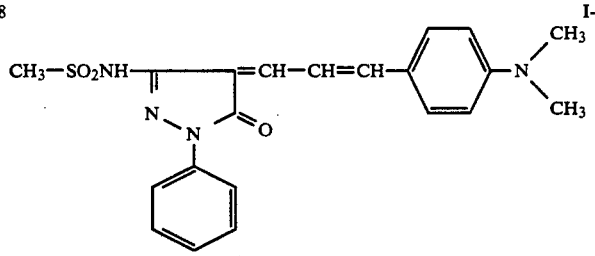
I-70
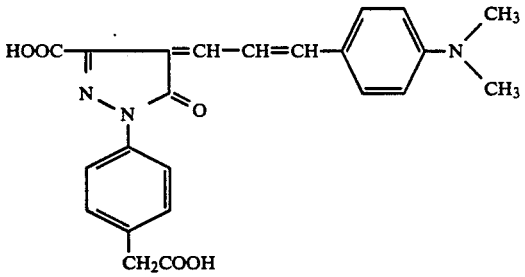
I-71
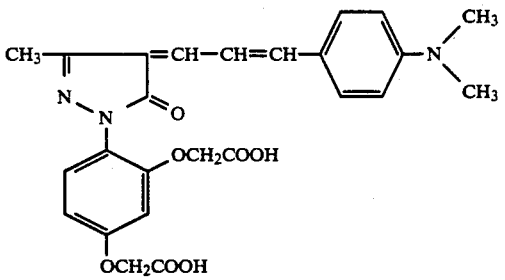
I-72
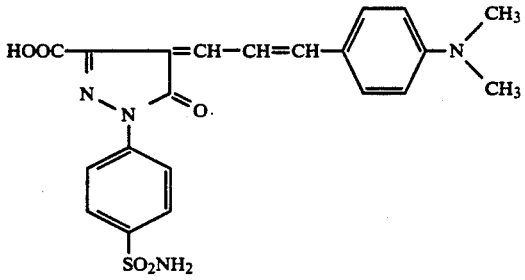
I-73
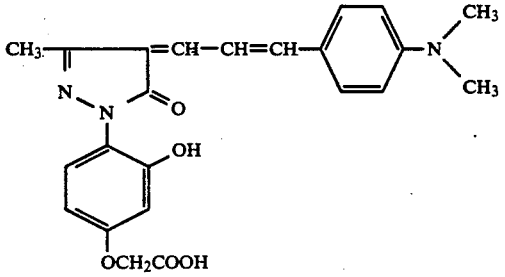

-continued
I-74
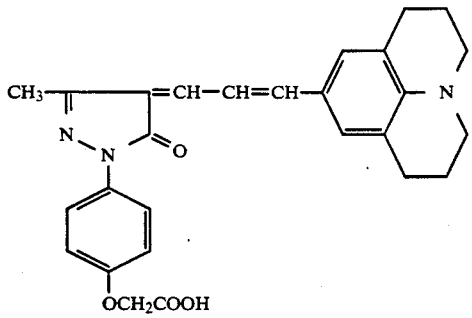
I-75
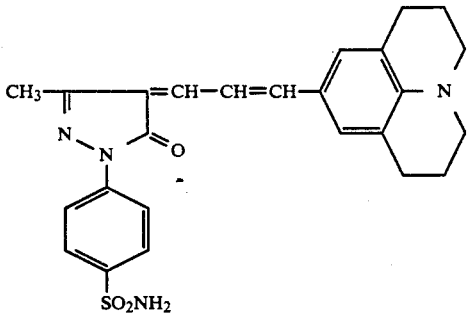
I-76
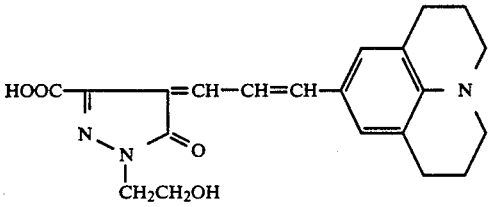
I-77
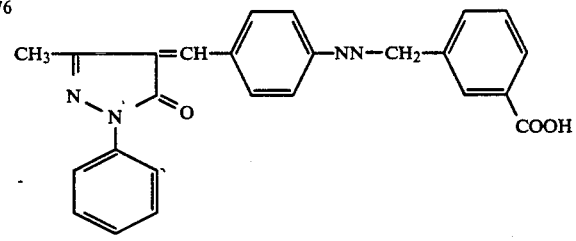
I-78
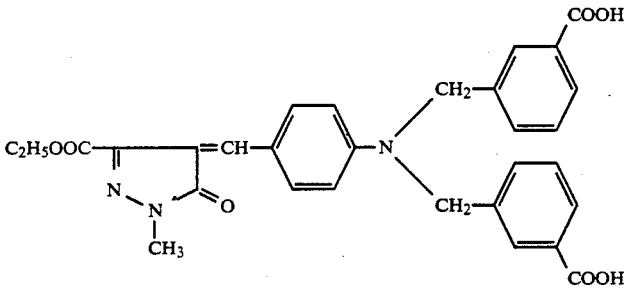
I-79
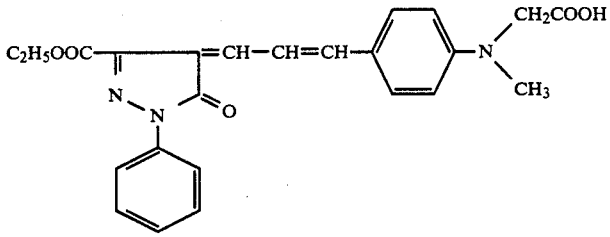
I-80
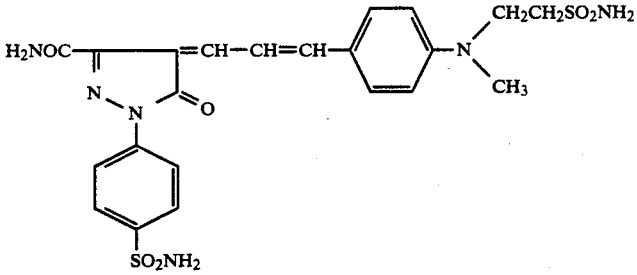
I-81
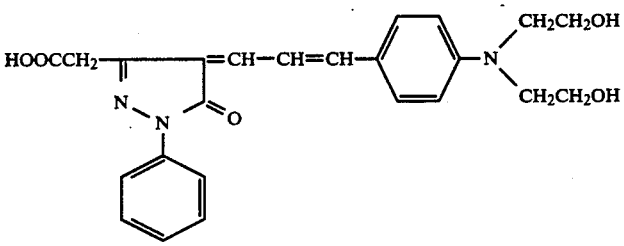

-continued
I-82
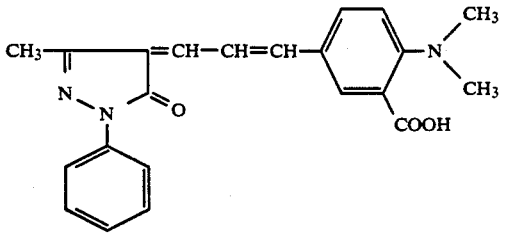
I-83
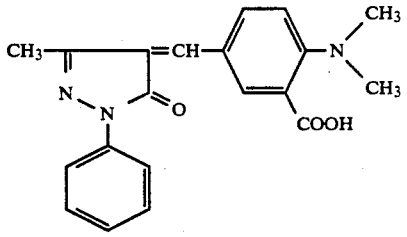
I-84
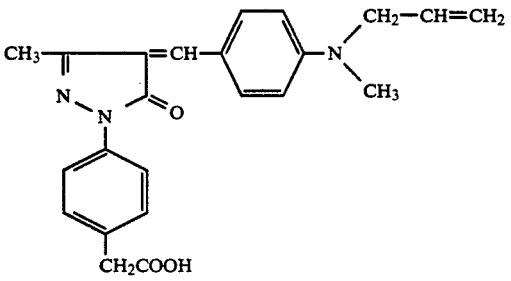
I-85
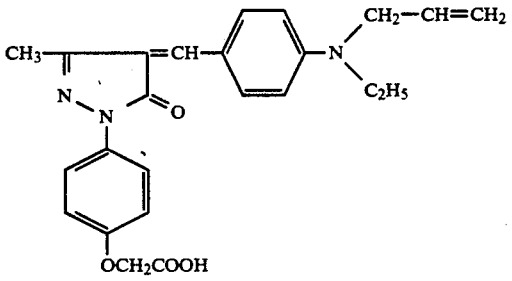
I-86
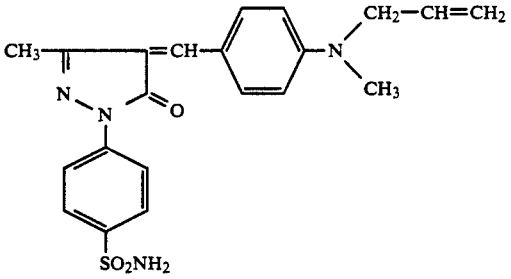
I-87
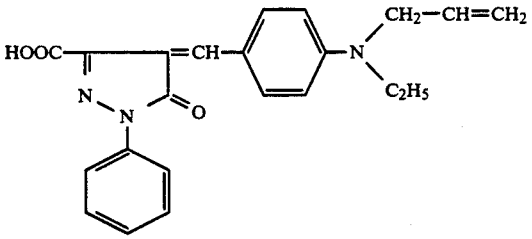
I-88
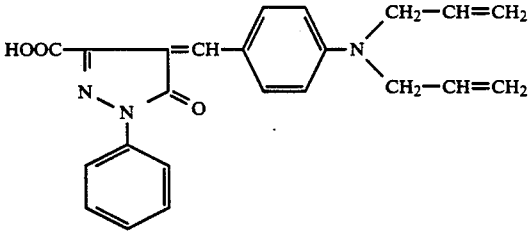
I-89
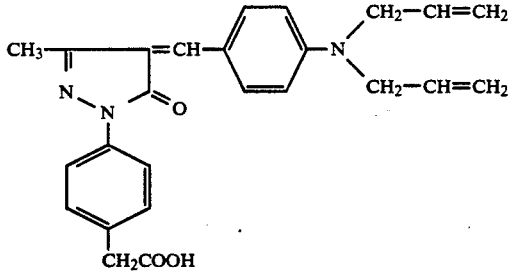
I-90
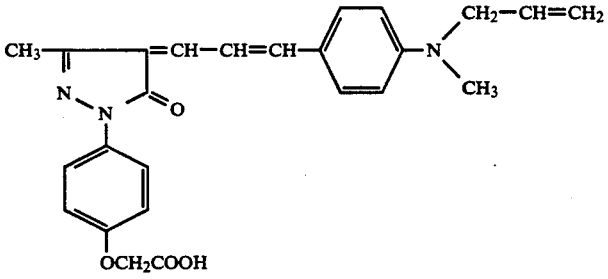

-continued
I-91
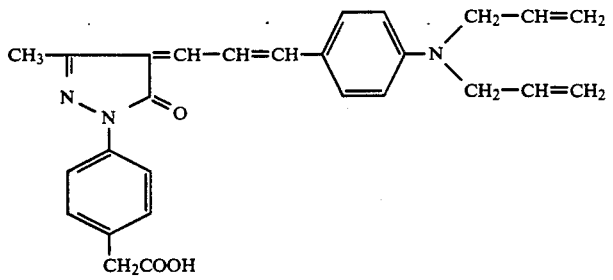
I-92
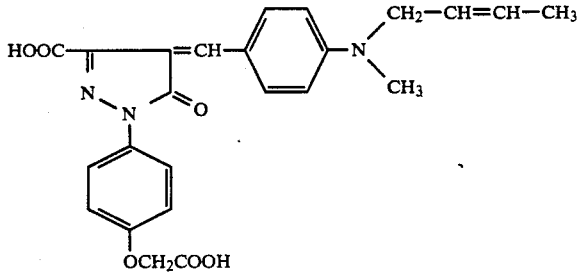
I-93
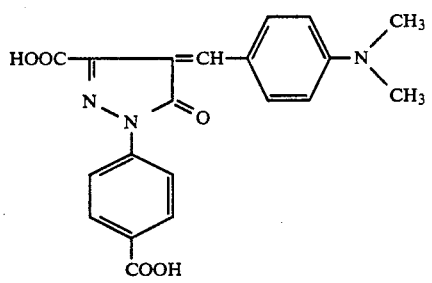
I-94
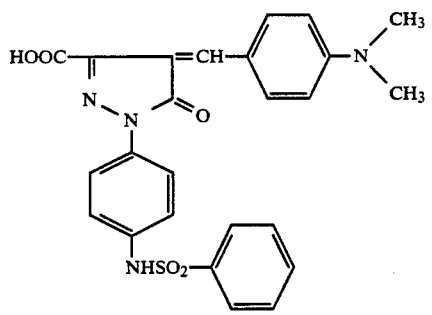
I-95
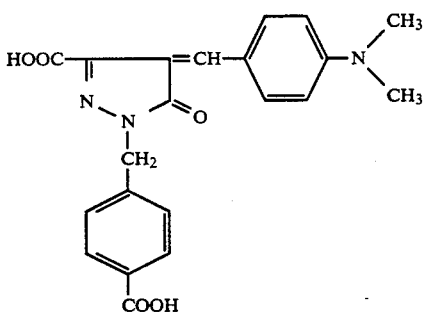
I-96
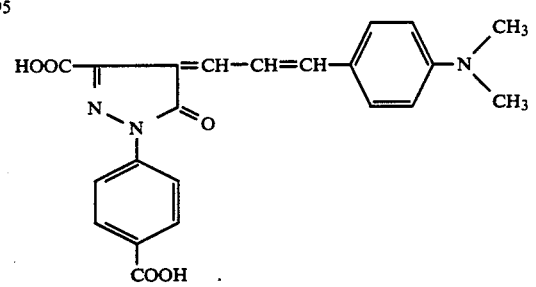
I-97
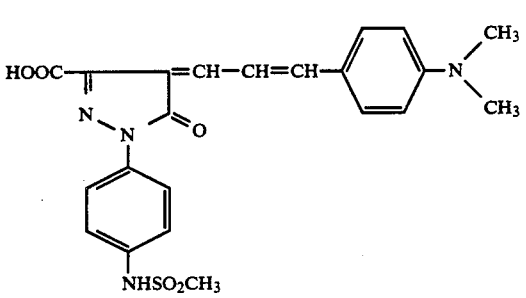
I-98
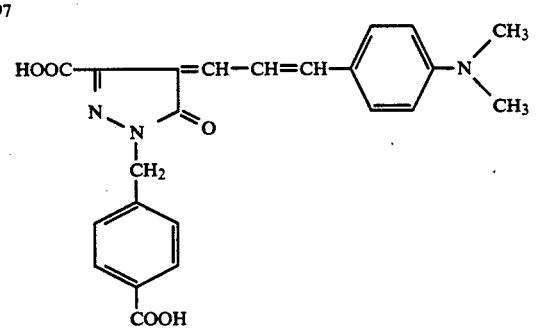

-continued

I-99

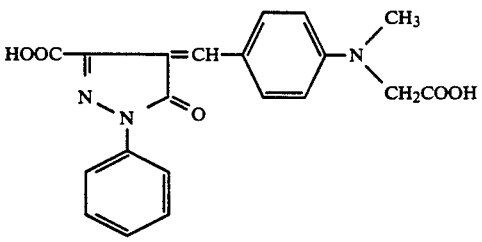

I-100

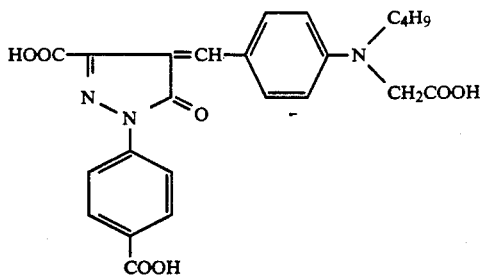

I-101

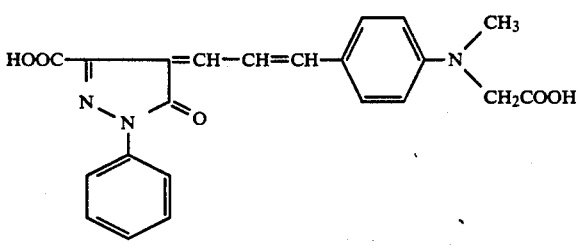

I-102

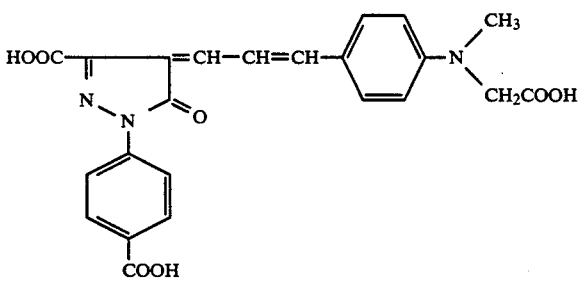

Synthesis of a couple of the compounds according to the invention are described below, other compounds of the invention can also be easily synthesized in similar manners.

SYNTHESIS 1

Synthesis of Illustrated Compound (1)

A mixture containing 23.2 g of 1-(4-carboxymethylphenyl)-3-methyl-pyrazoline-5-one, 14.9 g of 4-dimethylamino-benzaldehyde and 300 ml of ethanol was stirred and heated for 3 hours under refluxing. After cooling the reaction mixture, the product was filtered off. Then, it was made into a slurry with ethanol under refluxing, followed by filtering. This procedure was repeated again to isolate the product as a purified dye, so that 19.2 g of Compound (1) was obtained.

The structure of the compound was confirmed from its NMR, infrared spectrum and mass spectrum.

SYNTHESIS 2

Synthesis of Illustrated Compound (55)

A mixture containing 2.5 g of 1-(4-carboxymethoxylphenyl)-3-methyl-pyrazoline-5-one, 1.8 g of 4-dimethylamino-cinnamaldehyde and 10 ml of glacial acetic acid was stirred and heated for 10 minutes under refluxing. After cooling the reaction mixture, ethanol was added thereto, then the mixture was stirred and heated again under refluxing, followed by cooling. The product was filtered off, made into a slurry with ethanol under refluxing and filtered. It was made into a slurry with ethanol again and filtered, so that 1.8 g of refined Compound (55) was obtained.

The structure of the compound was confirmed from its NMR, infrared spectrum and mass spectrum.

The compound of the invention is used in the silver halide photographic light-sensitive material in amounts to give optical densities ranging from 0.05 to 3.0 at 680 nm according to a specific requirement.

Fine particle dispersion of the compound may be prepared by a method of precipitating the compound in a dispersion medium in a form of finely dispersed particles or a method of mechanically dispersing the compound by a known dispersing apparatus such as a ball mill, sand mill, colloid mill, jet mill and roller mill. In the method of precipitating the compound, for example, a solution of compound in a solvent is diluted with a poor solvent for the compound. And in another method, the compound is dissolve in water under a specified pH condition at which the compound can be dissolved and the pH is varied to precipitate the compound as fine particles. When precipitation of the compound, a surfactant may be used as a dispersing agent. The average size of compound particles in the dispersion is preferably 10 μm or less, more preferably 2 μm or less.

There is no particular limitation on the method to incorporate a fine solid particle dispersion of the compound of the invention in a light-sensitive material; one of applicable methods can be seen in U.S. Pat. No. 4,857,446.

As oil-soluble fluorescent whitening agent used in the invention, those represented by one of the following Formulas II-a, II-b, II-c and II-d are preferred.

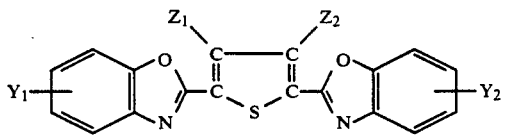

II-a

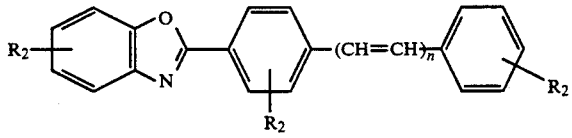

II-b

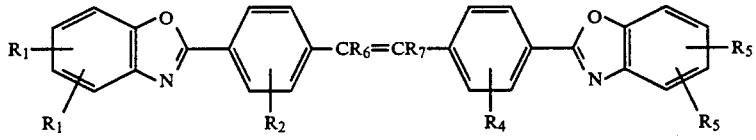

II-c

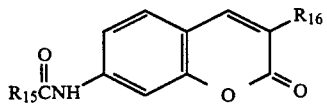

II-d

In the Formulas II-a to II-d, $Y_1$ and $Y_2$ each represent an alkyl group; $Z_1$ and $Z_2$ each are a hydrogen atom or an alkyl group; n is 1 or 2; $R_1$, $R_2$, $R_4$ and $R_5$ each represent an aryl, alkyl, alkoxy, aryloxy, hydroxyl, amino, cyano, carboxyl, amide, alkoxycarbonyl, alkylcarbonyl, alkylsulfo or dialkylsulfonyl group, or a hydrogen atom; $R_6$ and $R_7$ each represent a hydrogen atom, or an alkyl group such as methyl or ethyl, or a cyano group; $R_{16}$ is a phenyl group, a halogen atom, or an alkyl-substituted phenyl group; and $R_{15}$ is an amino group, or an organic primary or secondary amine.

Examples of the oil-soluble fluorescent whitening agent usable in the invention are the following II-1 to II-19.

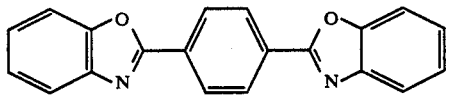

II-1

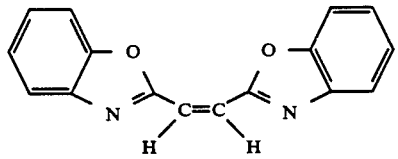

II-2

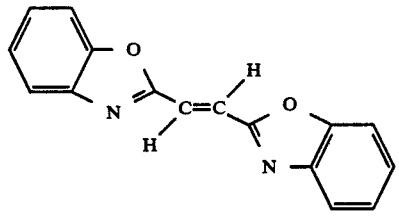

II-3

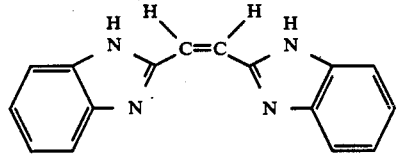

II-4

-continued
II-5
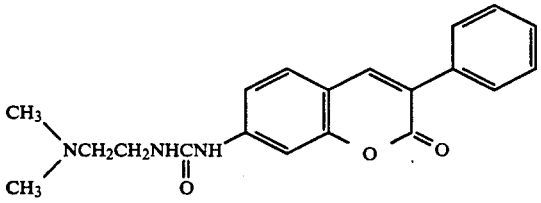
II-6
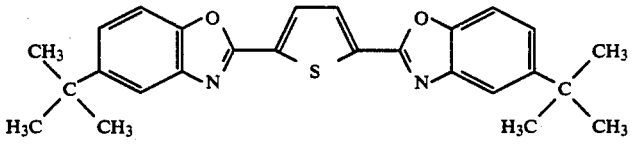
II-7
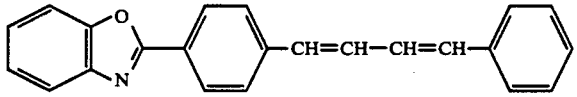
II-8
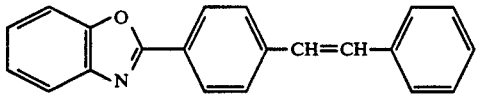
II-9
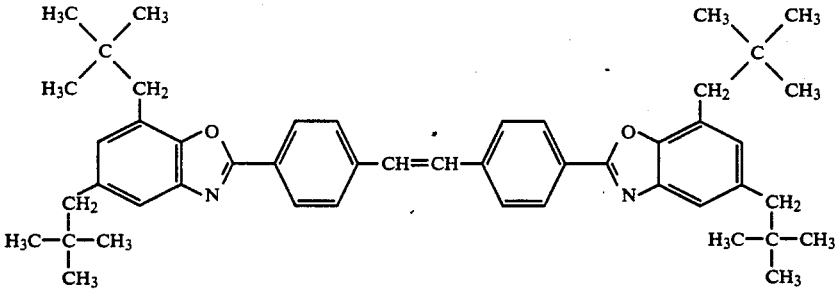
II-10
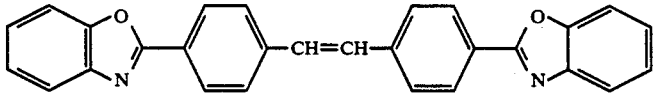
II-11
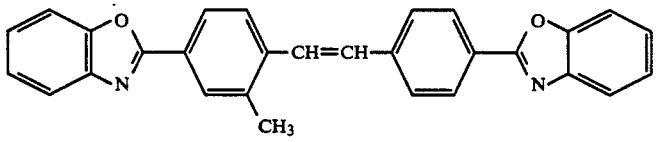
II-12
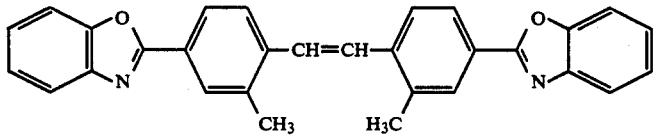
II-13
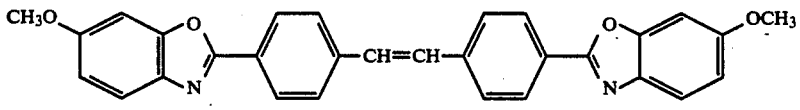
II-14
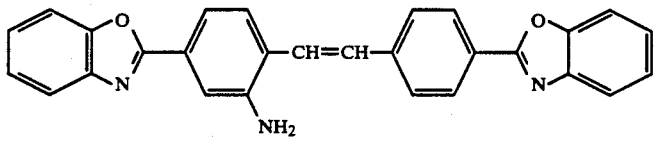

-continued

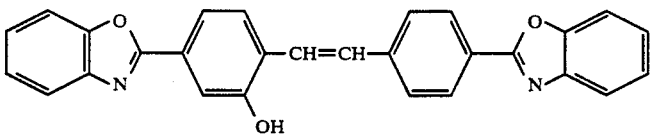

II-15

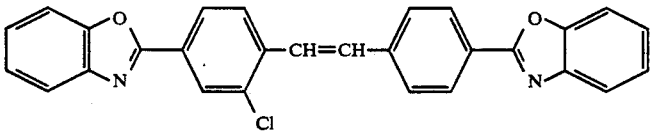

II-16

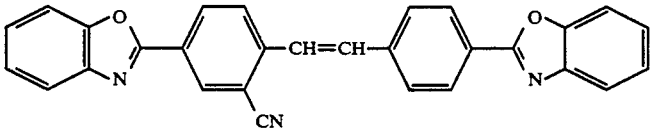

II-17

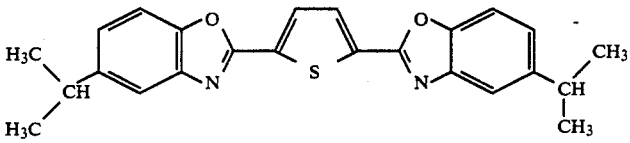

II-18

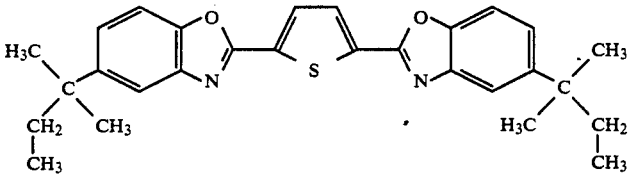

II-19

The oil-soluble fluorescent whitening agent may be used singly or in combination.

As the addition amount of these fluorescent whitening agents, it is preferable to have them present in a finished photographic paper within a range from 1 to 200 mg/m$^2$, and an addition amount of 5 to 50 mg/m$^2$ is particularly preferred.

In addition to single or combined use of themselves, these optical brighteners may be used together with other types of fluorescent whitening agents are used in combination, the total addition amount is preferably within the above limits.

While these optical brighteners may be added in any of the structural layers of the photographic layer on a support including the foregoing antihalation layer, it is preferable that they be added in both of the silver halide emulsion layer and antihalation layer.

These fluorescent whitening agents of the invention are added in objective layers as an emulsion, which is prepared by steps of dissolving them in a high boiling solvent, in combination with a low boiling solvent if necessary, mixing the solution with an aqueous solution of gelatin containing a surfactant, and emulsifying the mixture with a emulsifying apparatus such as colloid mill, homogenizer or supersonic disperser.

A silver halide emulsion preferably used in the light-sensitive material of the invention contains, as the silver halide, silver chlorobromide or silver chloroiodobromide having a silver chlorobromide content of more than 50 mol %, more preferably more than 60 mol %. These silver halide grains may be prepared by any of the acid method, neutral method and ammonia method, and the grain size of them is preferably larger than 0.2 μm and smaller than 0.5 μm.

In silver halide grains used in the emulsion of the invention, a water-soluble rhodium salt and a water-soluble iridium salt are made present at the inner part of the grains and/or on the surface thereof by adding them in the process of grain formation. The addition amount is preferably $10^{-6}$ to $10^{-9}$ mol per mol of silver halide.

Silver halide grains used in the invention may be ones having a uniform silver halide composition distribution or ones having a core-shell structure in which the silver halide composition is different from the inner portion to the surface of grains, or may be ones in which latent images are mainly formed on the surface of grains or ones in which latent images are mainly formed at the inner portion of grains.

The silver halide grains according to the invention may have any shape, and a preferable example is a cube having (100) faces as crystal faces. There may also be used octahedral, tetradecahedral and dodecahedral grains prepared by the methods described in U.S. Pat. Nos. 4,183,756, 4,225,666, Japanese Pat. O.P.I. Pub. No. 26589/1980, Japanese Pat. Exam. Pub. No. 42737/1980 and The Journal of Photographic Science, 21, 39(1973). Further, grains having twinned faces may also be utilized.

The silver halide grains according to the invention may be grains of single shape or a mixture of grains of different shapes.

Further, the grains may have any grain size distribution, an emulsion having a broad grain size distribution (so-called multidispersed emulsion) may be used, or an emulsion having a narrow grain size distribution (so-called monodispersed emulsion) may be used singly or as a mixture of several types of such emulsions. In addition, a mixture of a multidispersed emulsion and a monodispersed one may also be employed.

The silver halide emulsion may be a mixture of two or more kinds of silver halide emulsions prepared separately.

In the invention, a monodispersed emulsion is preferably used. A preferable, highly monodispersed emulsion of the invention has a monodispersion degree of less than 20, preferably less than 15, wherein said monodispersion degree is defined by the following equation:

$$\frac{\text{Grain size standard deviation}}{\text{Average grain size}} \times 100 = \text{Monodispersion degree}$$

The average grain size and grain size standard deviation in the equation are determined from ri defined as follows.

The term "average grain size $\bar{r}$" used here is defined by the grain size which makes the product of the frequency ni of grains having the grain size ri and $ri^3$ ($ni \times ri^3$) the largest. ri is expressed by 3 significant figures, with the third figure rounded to the nearest integer.

The term "grain size" used here means the diameter for a spherical silver halide grain, and the diameter of a circular image converted from a projected grain image of the same area for a grain having a shape other than sphere.

The grain size can be determined, for example, by photographing said grain in 10,000 to 50,000 magnifications with an electron microscope and measuring the diameter or projected area of said grain on the print. (The number of measured grains should be more than 1000 selected at random.) Such a monodispersed emulsion can be prepared according to the methods described in Japanese Pat. O.P.I. Pub. Nos. 48521/1979, 49938/1983 and 122935/1985.

A silver halide emulsion may be used as a so-called primitive emulsion which is not subjected to chemical sensitization; but, it is usually subjected to chemical sensitization in a procedure described, for example, in the foregoing books written by Glafkides and Zelik or Die Grundlagen der Photographischen Prozesse mit Silberhalogeniden, Akademische Verlagsgessellschaft, 1968, edited by H. Frieser.

That is to say, there can be used, in chemical sensitization, the sulfur sensitizing method which employs a sulfur-containing compound reactive with a silver ion, or an active gelatin; the reductive sensitizing method using a reducing substance, and the precious metal sensitizing method using a compound of precious metal such as gold. In the sulfur sensitizing method, there are used as sensitizers, for example, thiosulfates, thioureas, thiazoles, rhodanines, and the like; typical examples thereof can be seen in U.S. Pat. Nos. 1,574,944, 2,410,689, 2,278,947, 2,728,668 and 3,656,955. Usable reductive sensitizers include stannous salts, amines, hydrazine derivatives, thiourea dioxide, and silane derivatives; typical examples thereof are those described in U.S. Pat. Nos. 2,487,850, 2,419,974, 2,518,698, 2,983,609, 2,983,610 and 2,694,637. Sensitizers used in precious metal sensitization include gold complexes and complexes of other VIII group metals of the periodic table such as platinum, iridium and palladium; typical examples thereof are described in U.S. Pat. Nos. 2,399,083, 2,448,060 and British Pat. No. 618,061.

In chemical sensitization, the conditions such as pH, pAg and temperature are not particularly limited; but, it is preferable that the pH be maintained in a range from 4 to 9 and especially from 5 to 8; the pAg is maintained preferably in a range from 5 to 11, especially from 7 to 9; and the temperature is preferably 40° to 90° C., especially 45 to 75° C.

In addition to the foregoing individual sensitizing methods, the photographic emulsion used in the invention may be subjected to chemical sensitization in combination of sulfur sensitization and reductive sensitization or sulfur sensitization and precious metal sensitization such as sulfur-gold sensitization.

In the invention, the silver halide emulsion may be used singly or as a mixture of two or more kinds.

In embodying the present invention, there may be added to the emulsion various stabilizers including 4-hydroxy-6-methyl-1,3,3a,7-tetrazaindene, 5-mercapto-1-phenyltetrazole and 2-mercaptobenzothiazole, when the chemical sensitization is completed. Further, there may also be added a silver halide solvent such as thioether, or a crystal habit controlling agent such as mercapto-group-containing compound or sensitizing dye, according to a specific requirement.

The emulsion used in the invention may be subjected to desalting treatment to remove unnecessary soluble salts after silver halide grains are grown, or those salts may be left unremoved. Such a desalting treatment can be carried out according to the method described in Research Disclosure No. 17643.

In order to prevent sensitivity lowering and fogging in the course of manufacturing, storing or processing of a silver halide photographic light-sensitive material, the above photographic emulsion may contain various compounds such as azoles including benzothiazolium salt, nitroindazoles, triazoles, benzotriazoles, benzimidazoles, particularly nitro- or halogen-substituted ones, heterocyclic mercapto compounds including mercaptothiazoles, mercaptobenzimidazoles, mercaptothiazoles, mercaptotetrazoles, particularly 1-phenyl-5-mercaptotetrazole, mercaptopyridines, the above heterocycles having a water-solublizing group such as carboxyl or sulfo group; mercapto compounds, thioketo-compounds including oxazolinethion, azaindenes including tetrazaindenes, particularly 4-hydroxy-substituted(1,3-,3a,7)tetrazaindenes, benzenethiosulfonic acids and benzenesulfinic acids, which are well known as photographic stabilizers.

Examples of usable compounds are described, together with references to the originals, in The Theory of the Photographic Process, by K. Mees, 3rd Edition (1966).

Further details and uses of these compounds can be referred to, for example, U.S. Pat. Nos. 3,954,474, 3,982,947, 4,021,248 and Japanese Pat. Exam. Pub. No. 28660/1977.

The silver halide photographic light-sensitive material of the invention may contain an alkyl-acrylate-type latex described in U.S. Pat. Nos. 3,411,911, 3,411,912 and Japanese Pat. Exam. Pub. No. 5331/1970.

In addition, the silver halide photographic light-sensitive material of the invention may also contain various additives. Examples of these additives include thickeners or plasticizers described, for example, in U.S. Pat. Nos. 2,960,404, 3,767,410, Japanese Pat. Exam. Pub. No. 4939/1968, Japanese Pat. O.P.I. Pub. No. 63715/1973, German Auslegeshrift No. 1,904,604 and Belgian Pat. Nos. 588,143, 762,833, such as styrene-sodium maleate copolymers and dextran sulfates; hardeners of aldehyde type, epoxide type, ethyleneimine type, active halogen type, vinylsulfone type, isocyanate type, sulfonate type, carbodiimide type, mucochloric acid type and acyloyl type; and, as UV absorbents, compounds described, for example, in U.S. Pat. No. 3,253,921 and British Pat. No. 1,309,349, particularly 2-(2'-hydroxy-5-tert-butylphenyl)benzotriazole, 2-(2'-hydroxy-3',5'-di-tert-butylphenyl)benzotriazole, 2-(2-hydroxy-3'-tert-butyl-5'-butylphenyl)-5-chlorobenzotriazo le and 2-(2'-hydroxy-3',5'-di-tert-butylphenyl)-5-chlorobenzotriazole.

As surfactants used for coating aid, emulsifying agent, agent for accelerating penetration of developer, antifoaming agent or agent for controlling physical properties of light-sensitive material, anionic, cationic or amphoteric compounds may be used. Examples of such surfactants are described in British Patent Nos. 548,532 1,216,389, U.S. Pat. Nos. 2,026,202, 3,514,293, Japanese Pat. Exam. Pub. Nos. 26580/1969, 17922/1968, 17926/1968, 3166/1968, 20785/1973, French Pat. No. 202,588, Belgian Pat. No. 773,459 and Japanese Pat. O.P.I. Pub. No. 101118/1973. Among them, anionic surfactants having a sulfonic acid group such as succinate sulfonates and alkylbenzene sulfonates. As antistatic agents, there may be used the compounds described, for example, in Japanese Pat. Exam. Pub. Nos. 24159/1971, 39312/1971, 43809/1973, Japanese Pat. O.P.I. Pub. Nos. 89979/1973, 33627/1972 and U.S. Pat. Nos. 2,882,157, 2,972,535.

In the manufacturing course of the light-sensitive material of the invention, the pH of a coating solution is preferably in a range from 5.3 to 7.5. In case of multilayer coating, the pH of a mixed coating solution containing coating solutions at a ratio of coating weights of respective layers is preferably in a range from 5.3 to 7.5.

In the light-sensitive material of the invention, a constituent layer may contain a matting agent; examples thereof are inorganic particles such as silica described in Swiss Pat. No. 330,158, glass powder described in French Pat. No. 1,296,995, and carbonates of alkaline earth metals, cadmium, zinc which are described in British Pat. No. 1,173,181; and organic particles such as starch described in U.S. Pat. No. 2,322,037, starch derivatives described in Belgian Pat. No. 625,451 or British Pat. No. 981,198, polyvinyl alcohol described in Japanese Pat. Exam. Pub. No. 3643/1969, polystyrene or polymethylmethacrylate described in Swiss Pat. No. 330,158, polyacrylonitrile described in U.S. Pat. No. 3,079,257 and polycarbonate described in U.S. Pat. No. 3,022,169.

There may also be contained, in the constituent layer of the light-sensitive material of the invention, agents such as higher alcohol esters of higher fatty acids described in U.S. Pat. Nos. 2,588,756, 3,121,060, casein described in U.S. Pat. No. 3,295,979, calcium salts of higher fatty acids described in British Pat. No. 1,263,722, and silicone compounds described in British Pat. No. 1,313,384 and U.S. Pat. Nos. 3,042,522, 3,489,567. A liquid paraffin dispersion may also be employed for this purpose.

The light-sensitive material of the invention may further use various additives according to its use. These additives are described in detail in Research Disclosure Vol. 176, Item 17643 (Dec. 1978) and Vol. 187, Item 18716 (Nov. 1979) of the same.

As the reflective support of the invention, a barita coated paper or a paper coated or laminated by a layer of α-olefin polyer such as polyethylene, polypropylene and ethylene/butene copolymer is preferably used.

The photographic processing of a silver halide photographic light-sensitive material according to the invention is not limited to a particular method and may use various conventional methods. The processing temperature is usually set in between 18° C. and 50° C., but temperatures lower than 18° C. or higher than 50° C. may also be used.

As the developing agent contained in a black-and-white developer usable for development of the light-sensitive material of the invention, di-hydroxybenzenes (e.g., hydroquinone), 3-pyrazolidones (e.g., 1-phenyl-3-pyrazolidone) and aminophenols (e.g., N-methyl-p-aminophenol) are used singly or in combination, since they readily provide good results.

The silver halide photographic light-sensitive material of the invention may be processed in a developer containing imidazole as a silver halide solvent. Further, the light-sensitive material may also be processed in a developer containing such a silver halide solvent and an additive such as indazole or triazole. The developer may contain other additives such as preservative, alkali agent, pH buffer, antifoggant and, if necessary, solubilizing aid, tone controlling agent, developing accelerator, surfactant, defoamer, water softening agent, hardener and thickener.

In addition, the light-sensitive material can be subjected to the so-called lith-type development. As a special form of development, a developing agent may be contained in the light-sensitive material, for example, in an emulsion layer, which will be treated with an aqueous alkali for development. Hydrophobic developing agents can be incorporated in an emulsion layer according to the method described in Research Disclosure Vol. 169 and the like. Such a developing method may be combined with a silver-salt-stabilizing treatment using thiocyanates.

As fixers, those having conventional compositions can be used in the invention. These fixers may contain a water-soluble aluminium salt as a hardener.

Exposure of the photographic light-sensitive material of the invention varies with conditions of chemical sensitization the light-sensitive material undergone and its uses; accordingly, an optimum exposure is obtained by selecting a proper light source from various usable ones including tungsten lamp, fluorescent lamp, arc lamp, mercury lamp, xenon lamp, xenon flash tube, cathode ray tube flashing spot, laser beam, electron beam, X-ray, and fluorescent screen in X-ray photographing.

In addition to conventional exposure times of 1/1000 to 100 seconds, short time exposures of $1\times10^{-4}$ to $1\times10^{-9}$ second are applicable with light sources of xenon flash tube, cathode ray tube and laser beam irradiation.

EXAMPLES

Example 1

Preparation of dye dispersion

Dyes shown in Table 1 were each made up into a fine particle dispersion with a ball mill according to the following procedure.

Surfactant Alkanol XC (alkylnaphthalene-sulfonate made by Du pont), water, one of the dyes shown in Table 1, and zirconium oxide beads were placed in a ball mill vessel. After covering the vessel tightly with the lid, the dye was subjected to ball mill dispersing for 4 days.

Next, an aqueous solution of gelatin was added thereto, the contents were stirred for 10 minutes, and then the beads were removed to obtain a dye dispersion. The amount of each dye was adjusted to give a coating weight of 0.3 g/m$^2$.

Preparation of optical brightener dispersion

A solution prepared by dissolving 0.8 g of oil-soluble fluorescent whitening agent (II-6) in 25 ml of cresyl phenyl phosphate and 12 ml of 1-butanol was mixed with 260 ml of a 5%-aqueous gelatin solution containing 0.5 g of sodium tri-isopropylnaphthalene-sulfonate, then the mixture was dispersed with a supersonic disperser.

Preparation of coating solution for antihalation layer

The above dye dispersion and the above fluorescent whitening agent dispersion were added to an aqueous solution of gelatin so as to give coating weights shown in Table 1, and further, there were added sodium bis(2-ethylhexyl)succinate-2-sulfonate as a coating aid and a styrene/maleic anhydride copolymer as a thickener to obtain a coating solution for antihalation layer.

Preparation of coating solution for silver halide emulsion layer

| 1. Silver halide grain formation | |
|---|---|
| Solution 1 | |
| Ossein gelatin | 20 g |
| Water | 400 ml |
| Solution 2 | |
| $AgNO_3$ | 60 g |
| Water | 250 ml |
| Solution 3 | |
| AgCl | 18 g |
| KBr | 21 g |
| Water | 150 ml |
| Solution 4 | |
| KBr | 22 g |
| KI | 0.6 g |
| Water | 200 ml |
| Aqueous ammonia (28% solution) | 40 ml |
| Solution 5 | |
| $K_3RhBr_6$, (1% solution) | 1 ml |
| KBr (25% solution) | 1999 ml |
| Solution 6 | |
| $K_2[Ir(IV)Cl_6]$ (0.5% solution) | 0.75 g |
| Water | 36.75 ml |

To solution 1 was added 2 ml of solution 5 (the addition amount of the rhodium salt was $4.2\times10^{-6}$ mol per mol of silver halide), and 2 minutes later, solutions 2 and 3 were simultaneously added thereto over 5 minutes. After a 10-minute ripening, solution 4 was poured in 1 minute. When the addition of solution 4 was completed, 0.25 ml of solution 6 was pipetted out and added thereto (the addition amount of the iridium salt was $2.9\times10^{-7}$ mol per mol of silver halide). Then, the reaction liquor was ripened for 20 minutes and, after that, the pH was adjusted to 5.7 with 20% solution of acetic acid.

2. Desalting

To the above reaction liquor was added the following solution 7, followed by stirring for 5 minutes.

| Solution 7 | |
|---|---|
| Gelatin derivative for flocculation (90% of amino groups were substituted by —CONH— 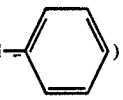 ) | 12 g |
| Water | 100 ml |

Subsequently, the pH was lowered to 4.4 with acetic acid, and after the gelatin was flocculated, the supernatant was poured out.

Next, 3 liters of deionized water was added and the pH was adjusted to 4.90 with sodium hydroxide. After stirring, the pH was lowered again to 4.60 with acetic acid in order to flocculate the gelatin, followed by decantation.

The above desalting procedure was repeated again, i.e., 3 times in total. Then, 100 mg of phenol and 4 mg of the following Compound (a) were added as antimolds, and the pH was finally adjusted to 5.90 to obtain emulsion A.

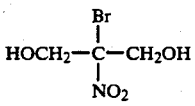

Compound (a)

3. Preparation of coating solution for silver halide emulsion layer

While keeping emulsion A prepared as above at 59° C., 270 mg/mol Ag of calcium chloride was added thereto, and then the emulsion was subjected to chemical sensitization by adding 270 mg/mol Ag of potassium bromide, 240 mg/mol Ag of ammonium thiocyanate, 10 mg/mol Ag of chloroauric acid and 6 mg/mol Ag of sodium thiosulfate.

Further, the following composition was added.

| | |
|---|---|
| Potassium bromide | 280 mg/mol Ag |
| Stabilizer (6-methyl-4-hydroxy-1,3,3a,7-tetrazaindene) | 1.7 g/mol Ag |
| Sensitizing dye (b) (b) 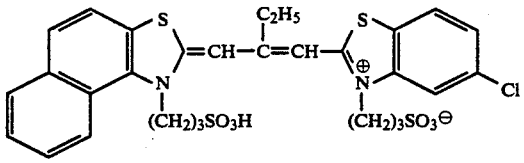 | 70 mg/mol Ag |
| Antifoggant (1-phenyl-5-mercaptotetrazole) | 60 mg/mol Ag |
| Coating aid (sodium tri-isopropylnaphthalene sulfonate) | 1 g/mol Ag |
| Agent for improving physical properties of coated layer (polyethylacrylate latex) | 60 g/mol Ag |
| Diethylene glycol | 20 g/mol Ag |

Next, the above fluorescent whitening agent dispersion was added as shown in Table 1, and there were further added a styrene-maleic anhydride copolymer as a thickener and 30 mg/g gelatin of a 1:0.25-mole reaction product of tetrakis(vinylsulfonylmethyl)methane and potassium taurine as a hardener, then the pH was adjusted to 5.5 with citric acid. A coating solution for silver halide emulsion layer was thus prepared.

Preparation of coating solution for protective layer

To a gelatin binder were added 70 mg/m$^2$ of polymethylmethacrylate having an average particle size of 3.5 μm as a matting agent, 6 mg/m$^2$ of sodium bis(2-ethylhexyl)succinate-2-sulfonate as a coating aid, 14 mg/m$^2$ of the following Compound (c) as a fluorine-containing surfactant, 100 mg/m$^2$ of the following Compound (d) as a dye for raising safelight tolerance, 25 mg/g gelatin of formalin as a hardener and 1 mg/m$^2$ of 1-phenyl-5-mercaptotetrazole, and then the pH was adjusted to 5.5 with citric acid to obtain a coating solution for protective layer.

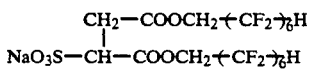

Compound (c)

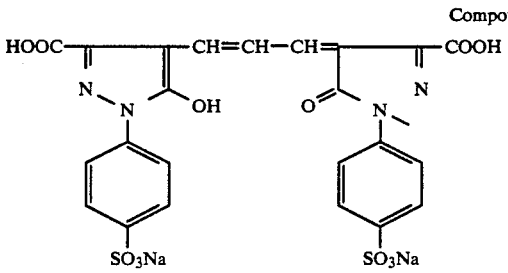

Compound (d)

Coating

The coating solution for antihalation layer, the solution for silver halide emulsion layer and the coating solution for protective layer were multi-layeredly coated in the above order from the support side on a 110-μm-thick polyethylene-coated paper support having a gelatin subbing layer (gelatin coating weight: 0.2 g/m$^2$). Immediately before the start of coating, within 10 seconds, there were added 0.7 g/mol Ag of 1-phenyl-3-pyrazolidone and 5 g/mol Ag of the following Compound (i) to the coating solution for silver halide emulsion layer.

$HOCH_2SO_3Na$ Compound (i)

The coating weight of silver was 1.5 g/m$^2$; the coating weights of gelatin were 0.5 g/m$^2$ for the antihalation layer, 0.9 g/m$^2$ for the emulsion layer and 1.1 g/m$^2$ for the protective layer.

Preparation of comparative sample

The gelatin amounts in the coating solution for silver halide emulsion layer and in the coating solution for protective layer prepared in Example 1 were modified, and further a dye represented by Formula I and fluorescent whitening agent (II-13) were added to the coating solution for emulsion layer as shown in Table 1. Then, those were coated on the same support as that in Example 1 so as to give gelatin coating weights of 1.2 g/m$^2$ for the emulsion layer and 1.3 g/m$^2$ for the protective layer.

Exposure

Samples prepared as above were exposed to an LED laser beam for $10^{-6}$ second through an optical wedge.

Processing

After the exposure, each sample was developed with the developer of the following composition, and subsequently fixed, washed and dried. For processing, an Automatic Developing Machine Model GR-26 made by Konica Corp. was used. The development was carried out at 38° C. for 20 seconds.

| <Developer> | |
|---|---|
| Deionized water | about 800 ml |
| Potassium sulfite | 60 g |
| Disodium ethylenediaminetetracetate | 2 g |
| Potassium hydroxide | 10.5 g |
| 5-Methylbenzotriazole | 300 mg |
| Diethylene glycol | 25 g |
| 1-Phenyl-4,4-dimethyl-3-pyrazolidone | 300 mg |
| 1-Phenyl-5-mercaptotetrazole | 60 mg |
| Potassium bromide | 3.5 g |
| Hydroquinone | 20 g |
| Potassium carbonate | 15 g |

Deionized water was added to make 1000 ml. The developer's pH was 10.8

| <Fixer> | |
|---|---|
| (Composition A) | |
| Ammonium thiosulfate (72.5% W/V aquerous solution) | 240 ml |
| Sodium sulfite | 17 g |
| Sodium acetatetrihydrate | 6.5 g |
| Boric acid | 6 g |
| Sodium citratedihydrate | 2 g |
| Acetic acid (90% W/W aqueous solution) | 13.6 ml |
| (Composition B) | |
| Deionized water | 17 ml |
| Sulfuric acid (50% W/W aqueous solution) | 4.7 g |
| Aluminium sulfate (8.1% W/W aqueous solution as $Al_2O_3$) | 26.5 g |

At the time of using the fixer, composition A and composition B were dissolved in 500 ml of water in this order and the total volume was made up to 1 liter. The fixer's pH was about 4.3.

The reflection density of each processed sample was measured with a Sakura Digital Densitometer Model PDA-65 made by Konica Corp. to evaluate the photographic characteristics.

The sensitivity was given as a reciprocal of an exposure necessary to obtain optical density 1.0 and expressed by a value relative to the sensitivity of sample 6 which was set at 100. γ was indicated by the tangent of a straight line portion in a characteristic curve; the larger γ value is, the harder the gradation is.

Further, the sharpness and whiteness were visually rated with marks from 1 to 5; a larger value indicates a better property.

TABLE 1

| Sample | Layer | Antihalation layer | | Emulsion layer |
|---|---|---|---|---|
| | | Coating weight | Fluorescent whitening agent | Fluorescent whitening agent |

TABLE 1-continued

| No. | configuration | Dye | mg/m² | mg/m² | mg/m² |
|---|---|---|---|---|---|
| 1 | Two layers | — | — | — | 30 |
| 2 | Three layers | — | — | 30 | — |
| 3 | Three layers | Comparative dye (A) | 200 | — | — |
| 4 | Three layers | Comparative dye (A) | 200 | 30 | — |
| 5 | Three layers | Comparative dye (A) | 300 | 30 | — |
| 6 | Three layers | I-54 | 300 | — | — |
| 7 | Three layers | I-54 | 300 | 30 | — |
| 8 | Three layers | I-102 | 300 | — | — |
| 9 | Three layers | I-102 | 300 | 30 | — |

| Sample No. | Photographic properties: Fog | Sensitivity | Gamma | Maximum density | Whiteness | Sharpness | Remarks |
|---|---|---|---|---|---|---|---|
| 1 | 0.01 | 145 | 3.0 | 1.85 | 4.0 | 0.5 | Comparison |
| 2 | 0.00 | 145 | 3.0 | 1.88 | 3.75 | 0.5 | Comparison |
| 3 | 0.04 | 110 | 4.0 | 1.82 | 1.5 | 3.5 | Comparison |
| 4 | 0.05 | 100 | 4.2 | 1.80 | 4.5 | 4.0 | Comparison |
| 5 | 0.09 | 65 | 5.1 | 1.70 | 2.5 | 4.5 | Comparison |
| 6 | 0.02 | 130 | 4.5 | 1.83 | 2.0 | 5.0 | Comparison |
| 7 | 0.02 | 129 | 4.7 | 1.81 | 4.75 | 5.0 | Invention |
| 8 | 0.02 | 132 | 4.4 | 1.84 | 2.2 | 5.0 | Comparison |
| 9 | 0.02 | 130 | 4.6 | 1.82 | 4.75 | 5.0 | Invention |

Comparative dye (A)

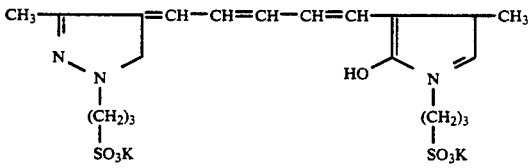

It can be seen from the results in Table 1 that the samples of the invention are not only high in whiteness and sharpness but good in sensitivity and fog as well.

What is claimed is:

1. A silver halide photographic light-sensitive material comprising a reflective support having thereon a photographic layer including a silver halide emulsion layer and an atihalation layer provided between said support and said silver halide emulsion layer, wherein said antihalation layer contains fine dispersed particles of a compound represented by the following formula I, and at least one of said silver halide emulsion layer and said antihalation layer contains a fluorescent whitening agent;

$$A{=}L_1{\leftarrow}L_2{=}L_3{\rightarrow}_m B \qquad (I)$$

wherein A is a 2-pyrazoline-5-on nucleus; B is an 4-aminoaryl group; $L_1$, $L_2$ and $L_3$ are each a methine group; and m is 0 or 1, provided that the compound satisfies at least one of the following requirements;

(1) said aminoaryl group represented by B has a carboxyl group, a sulfonamido group, an aminosulfonylamino group or a sulfamoyl group, (2) said 2-pyrazoline-5-on nucleus represented by A has a carboxyl group; a sulfonamido group; an aminosulfonylamino group; an aliphatic group having a carboxyl group, a sulfonamido group or an aminosulfonylamino group; a heterocyclic group having a carboxyl group, a sulfonamido group or an aminosulfonylamino group; an aryl group having a carboxyl group, a sulfonamido group or an aminosulfonylamino group; or a group having a sulfamoyl group.

2. The light-sensitive material of claim 1, wherein said fluorescent whitening agent is a oil-soluble fluorescent whitening agent represented by the following formula II-a, II-b, II-c or II-d;

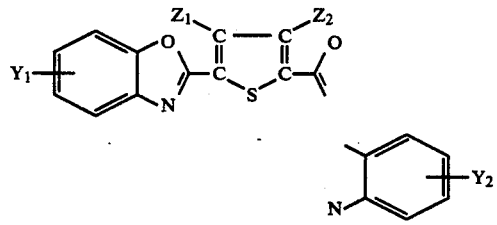

(II-a)

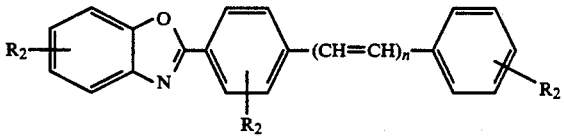

(II-b)

-continued
(II-c)
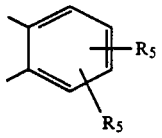
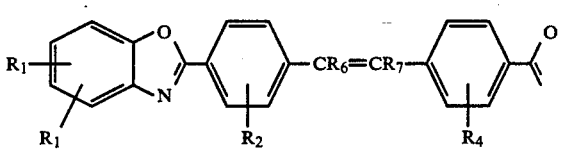

-continued

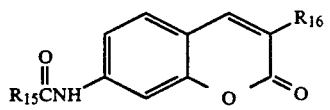

(II-d)

wherein $Y_1$ and $Y_2$ are each an alkyl group; $Z_1$ and $Z_2$ are each a hydrogen atom or an alkyl group; n is an integer of or 2; $R_1$, $R_2$, $R_4$ and $R_5$ are each an aryl group, an alkyl group, an alkoxy group, an aryloxy group, a hydroxy group, an amino group, a cyano group, a carboxyl group, an amido group, an alkoxycarbonyl group, an alkylcarbonyl group, an alkylsulfo group, a dialkylsulfonyl group or a hydrogen atom; $R_6$ and $R_7$ are each a hydrogen atom, an alkyl group or a cyano group; $R_{15}$ is an amino group or an organic primary or secondary amino group; and R16 is a phenyl group, an alkyl-substituted phenyl group or a halogen atom.

3. The light-sensitive material of claim 1, wherein said fluorescent whitening agent is contained in said photographic layer in an amount of from 1 mg to 200 mg/m$^2$.

4. The light-sensitive material of claim 3, wherein said fluorescent whitening agent is contained in said photographic layer in an amount of from 5 mg to 50 mg/$^2$.

5. The light-sensitive material of claim 1, wherein said fluorescent whitening agent is contained in said silver halide emulsion layer and said antihalation layer.

6. The light-sensitive material of claim 1, wherein silver halide grains contained in said silver halide emulsion layer comprises not less than 50 mol% of silver chloride.

7. The light sensitive material of claim 1, wherein said compound represented by formula I is contained in said antihalation layer in an amount necessary for making a reflective optical densitiy of said antihalation layer of from 0.05 to 3.0 under light of 680 nm.

* * * * *